US005240403A

United States Patent [19]

McAnespie

[11] Patent Number: 5,240,403

[45] Date of Patent: Aug. 31, 1993

[54] REGENERATIVE THERMAL OXIDATION APPARATUS AND METHOD

[75] Inventor: Donald I. McAnespie, Tecumseh, Canada

[73] Assignee: Moco Thermal Industries, Inc., Romulus, Mich.

[21] Appl. No.: 939,284

[22] Filed: Sep. 1, 1992

[51] Int. Cl.[5] ..... F23D 14/00

[52] U.S. Cl. ..... 431/5; 431/215; 432/181; 110/190

[58] Field of Search ..... 431/5, 215, 161; 432/180, 181; 422/111, 175, 170, 182; 110/233, 211, 190

[56] References Cited

U.S. PATENT DOCUMENTS

| | | | |
|---|---|---|---|
| 1,933,571 | 11/1933 | Trinko | 432/20 |
| 1,943,957 | 1/1934 | Godard | 432/181 |
| 4,302,426 | 11/1981 | Benedick . | |
| 4,358,268 | 11/1982 | Neville | 432/180 |
| 4,426,360 | 1/1984 | Benedick . | |
| 4,454,826 | 6/1984 | Benedick . | |
| 4,470,806 | 9/1984 | Greco . | |
| 4,474,118 | 10/1984 | Benedick . | |
| 4,650,414 | 3/1987 | Grenfell . | |
| 4,658,853 | 4/1987 | Pennington . | |
| 4,793,974 | 12/1988 | Hebrank . | |
| 4,802,423 | 2/1989 | Pennington . | |
| 4,828,483 | 5/1989 | Finke | 431/215 |
| 4,909,307 | 3/1990 | Besik . | |
| 4,923,391 | 5/1990 | Gitman . | |
| 4,942,832 | 7/1990 | Finke | 110/190 |
| 4,943,231 | 7/1990 | Jenkins et al. . | |
| 4,961,908 | 10/1990 | Pennington et al. . | |
| 5,016,547 | 5/1991 | Thomason . | |
| 5,024,817 | 6/1991 | Mattison . | |
| 5,044,939 | 9/1991 | Dehlsen . | |
| 5,092,767 | 3/1992 | Dehlsenl . | |
| 5,098,286 | 3/1992 | York . | |
| 5,101,741 | 4/1992 | Gross et al. . | |
| 5,129,332 | 7/1992 | Greco . | |
| 5,134,945 | 8/1992 | Reimlinger et al. . | |
| 5,143,700 | 9/1992 | Auguil . | |

OTHER PUBLICATIONS

Brochure, Ross Air Systems Div., Somerset Technologies, Inc., "Regenerative Incinerators", 6 pp., undated.

(List continued on next page.)

*Primary Examiner*—Larry Jones

*Attorney, Agent, or Firm*—Harness, Dickey & Pierce

[57] ABSTRACT

An improved regenerative thermal oxidizer ("RTO") and improved method of operating same in order to provide a substantially steady-state flow of contaminant-laden air into the RTO. The RTO includes an automatically-operated balancing valve structure for minimizing pressure variations experienced at the inlet of the RTO. The balancing valve is connected to and provides a selectively closeable bypass path for air flow between the high pressure and low pressure sides of an exhaust fan. The balancing valve opens the bypass path whenever flush valves of the RTO are all closed. The RTO further includes a hydraulic control system for minimizing variations in the operation of the RTO due to varying ambient or seasonal temperature conditions to which the RTO may be subjected. The RTO additionally includes a gravity-actuated damper valve structure near the top of a vertically arranged exhaust stack. The damper valve automatically prohibits entry of a stream of cold air into the exhaust stack, while automatically allowing heated processed air to escape the exhaust stack. The RTO is operated according to an improved six-step sequence which provides for the substantially steady-state inlet air flow, due to highly stable air draw rates. The six-step sequence maintains mass air flow rates constant, even though the inlet and outlet valves to the heat exchange chambers of the RTO are opening and closing, and produce periodic air flow reversals within the heat exchange chambers. During the six-step sequence, the steady-state flow is also maintained by opening and closing the balancing valve in a way which counteracts the effects of stopping and starting the flushing gases which are periodically circulated through the heat exchange chambers.

21 Claims, 6 Drawing Sheets

OTHER PUBLICATIONS

Brochure, Regenerative Environmental Equipment Co., Inc., "The Pacesetting RE-TMERM VF Compact, High-Efficiency Fume and Odor Control for Smaller Air Volumes", 5 pp. (1987).

Brochure, M&W Industries, Inc., "Thermal Incineration", 8 pp., undated.

Brochure, Thermo Electron Wisconsin, Inc., "Thermo Reactor Regenerative Incinerator", 6 pp., undated.

Brochure, Smith Engineering Company, Smith Environmental Corporation, "When the problem is air polution control, Smith offers more than one solution", 2 pp., undated.

Brochure, Smith Engineering Company, Smith Environmental Corporation, "Smith Regenerative Thermal Oxidizers for VOC Emissions and Odor Control", 6 pp. (1990).

30
36
38
40
41
42
48
50
52
54
58
60
64
70
74
78
83
84
85
86
87
89
130
131
132
133
137
138
139
147
148
149
151
152
153
170
172
173
174
175
176
177
178
179
180
182
183
187
188
189
197
198
199
201
202
203
207
208
209
211
212
213
217
218
219
240
241
242
243
251
252
253
261
262
263
264
265
266
267
270

FIG-3
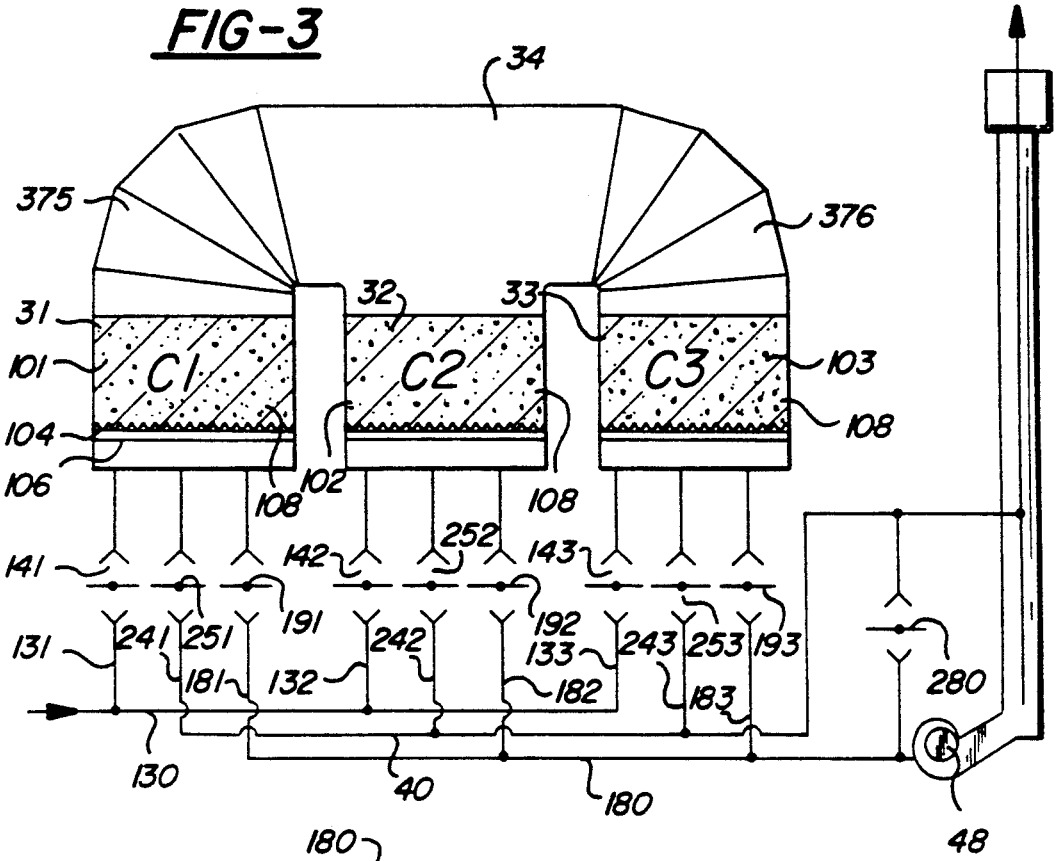
FIG-4
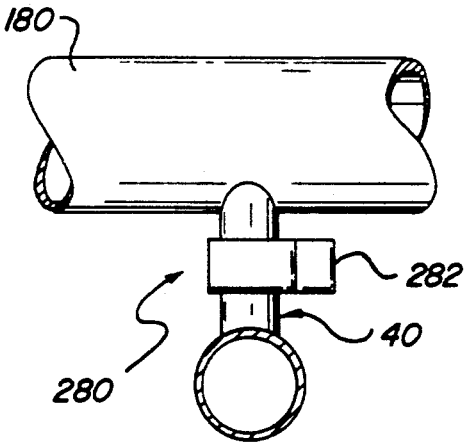
FIG-9
| | A | B | C | D | E | F |
|---|---|---|---|---|---|---|
| C1 | IN | | FLUSH | OUT | | IDLE |
| C2 | OUT | IDLE | IN | | FLUSH | OUT |
| C3 | FLUSH | OUT | | IDLE | IN | |

REGENERATIVE THERMAL OXIDATION APPARATUS AND METHOD

BACKGROUND OF THE INVENTION

1. Field of the Invention

The present invention relates in general to regenerative thermal oxidation ("RTO") equipment and methods for operating same, and in particular to improvements in RTO equipment, operating cycles and hydraulic controls designed to stabilize air flow rates through the RTO equipment and to provide for more efficient self-cleaning cycles.

2. Description of the Related Art

As world-wide environmental awareness heightens, industry is being confronted with increased governmental requirements for treating air laden with contaminants from industrial processes. Regulations governing the emissions of volatile organic compounds are no exception. To remain competitive in the global marketplace, companies having manufacturing facilities will need to find cost-effective solutions for emission controls. Such emissions are often associated with manufacturing plants for high-speed printing, food processing, metal processing, painting, can manufacturing and the like.

It is well-known that noxious fumes containing volatile organic compounds (VOCs), including hydrocarbons or undesirable odors, can be destroyed at temperatures of about 1500° Fahrenheit or higher. The fumes, specifically the contaminants in the air, are converted at such temperatures into harmless water vapor and carbon dioxide. Generally, thermal incineration systems designed to accomplish this conversion can usually be categorized as a recuperative design or a regenerative design. Briefly, recuperative systems utilize plate or tubular-type heat exchangers to obtain the required pre-heat temperatures necessary to purify contaminated air. Regenerative systems utilize high-density heat storage media to transfer heat directly to the incoming process air stream. The major advantage of regenerative systems is the ability to achieve primary heat recovery efficiencies in excess of 95 percent while eliminating on the order of 95 to 98 percent (or more) of the combustible contaminants.

Generally, regenerative thermal oxidizers include two or more fixed bed regenerative heat exchangers connected to a common combustion or incineration chamber. Contaminant-laden air is directed through one of the heat exchangers where it is pre-heated. Thereafter, it is directed to the combustion chamber where the contaminants are burned, that is completely oxidized. Because a mixture of combustion air and hydrocarbon fuel is added in the combustion chamber, hot combustion gases are produced, and these are then exhausted through another of the heat exchangers where they give up a major portion of their heat content before being discharged to the atmosphere through an exhaust fan. Periodically, flow through the system is reversed. The incoming contaminant-laden air is then heated by the heat exchanger which was previously heated by the exiting combustion gases, and the heat exchanger previously cooled by the incoming air is re-heated by the exiting combustion gases.

The flow reversals through the chambers are accomplished by having separate inlet and outlet flow structures connected to each chamber. These flow structures include main ducts and branch ducts in which large butterfly valves are located. The valves are opened and closed by valve operator units that are electrically, mechanically or hydraulically driven. The exhaust fan is typically a centrifugal fan, and continuously runs in one direction, even while the flow reversals from the heat exchange chambers are taking place.

During the periodic flow reversals, there is an opportunity for small amounts of unprocessed contaminated air to be transferred from the inlet side of the heat exchange chambers directly to the outlet side and exhaust fan. The undesired transfer occurs when contaminated gases that have already entered a heat exchange chamber, but have not yet reached the combustion chamber, are drawn out as the chamber is switched over so as to be connected to the outlet flow structure rather than the inlet flow structure. To avoid this problem, a flush flow structure, including main and branch flushing ducts and flushing valves located in the branch ducts, have been added to RTO equipment. The flush flow structure and operating of the flushing valves further complicate the task of attempting to finely regulate and stabilize the flow of process air drawn from plant processing equipment into an RTO.

While the approaches of prior regenerative thermal oxidizers have been successful, they have not been entirely satisfactory. For example, prior systems have not been able to finely control mass flow through the system, on account of the periodic flow reversals required through the heat exchange chambers. To assist in achieving even flow rates, very expensive variable speed electric motor drive systems have been used to drive the large exhaust fan at some constant speed selected from a range of possible speeds. This tends to keep the draw produced by the exhaust fan constant, especially when electronic feedback is used to help stabilize fan speed. However even these variable speed drives are not fully satisfactory at achieving exceedingly uniform flow rates at the inlet to the RTO equipment.

Precise control of the inlet flow rate in RTOs is important in certain applications. For example, in a paint booth or oven, the amount of paint on a part may be altered by changes in the rate at which solvent-laden air is drawn into the RTO. Also, on a conveyor line operation for coating aluminum beverage cans, abrupt pulsations in air pressure at the inlet of an RTO, due to flow reversals within the RTO's heat exchange chamber, may produce a surge of air capable knocking over the empty cans on the conveyor belt. As a final example, solvent-laden air may be "burped" out of the front end of a continuous oven from which contaminated air is being drawn by an RTO, if the RTO unit temporarily but significantly diminishes the rate at which contaminated air is being drawn into the RTO, sending the contaminated air into the plant. These and other kinds of air pressure variation problems still occur with existing RTO equipment.

Another problem with existing RTO equipment is that its operation is subject to variation and change over time. The present inventor has traced the cause of many of these variations to changes in the ambient temperature of the environment in which RTO equipment operates. Those in the art will appreciate that RTO equipment, due to its size, is frequently located outside of a processing plant. Such RTO equipment is thus subject to wide swings in ambient temperature due to climatic changes such as differences between daytime and evening temperatures, winds, rain and seasonal temperature variations. These temperature variations, Applicant has discovered, can adversely affect how consistently the RTO equipment operates. Such time and temperature variations degrades equipment performance, particularly the uniformity of valve operation, which, in turn, produces variations in the inlet flow rate or draw of the RTO equipment.

Accordingly, it is a first important object of the present invention to provide an RTO apparatus that produces a highly stabilized draw of air into the RTO apparatus, even as the inlet valves, outlet valves and flushing valves of the RTO equipment open and close. A related object of the present invention is to provide an improved method for operating a regenerative thermal oxidizer that minimizes changes to mass air flow rates, in spite of the periodic changes to the direction of air flow through each of the heat exchange chambers. In other words, the object is to provide for minimum disturbance of the mass flow rate into the RTO even when each of the heat exchangers are alternately operated in a heat absorbing mode, a heat radiating mode, and a flushing mode. Still another related object is to provide an improved six-step sequence of operation for the inlet, outlet and flushing valves which preserves maximum thermal and emission efficiencies, while achieving very stable flow rates.

A second important object of the present invention is to provide for an improved hydraulic control system that provides for highly stable valve operating characteristics over time, even when the RTO equipment is operated out-of-doors in an environment experiencing wide swings in temperature between day and night or from season-to-season.

One more object of the present invention is to eliminate the problem associated with regenerative thermal oxidizers which sometimes emit solvent-laden air into a plant's environment as inlet, outlet and flushing valves switch from one state to the next.

Still further, it is an object of the present invention to provide an improved RTO apparatus and method for removing the build-up of solid residue materials (i.e., contaminants) from the duct work and valves of the inlet flow structure leading to the RTO's heat exchange chambers. A related object is to shorten bake-out cycle times and reduce fuel consumption by eliminating sources of inefficiencies which arise during such bake-out cycles.

SUMMARY OF THE INVENTION

In light of the foregoing problems and to achieve a number of the above-mentioned objects, there is provided, according to a first aspect of the present invention, an improved method of operating RTO equipment in order to provide a substantially steady-state flow of contaminant-laden air into RTO equipment of the type described above. Specifically, this type of RTO equipment includes: an exhaust fan with low and high pressure sides; at least first, second and third heat exchange chambers in fluid communication with various flow structures and a combustion chamber common to each of the heat exchange chambers. The flow structures include an inlet flow structure connectable to plant process equipment from which contaminant laden air is to be drawn, an outlet flow structure in fluid communication with the low pressure side of the exhaust fan, and a flush flow structure in fluid communication with the high pressure side of the exhaust fan. Each heat exchange chamber contains heat storage media through which the contaminant-laden air is passed.

The improved method for providing substantially steady state flow comprises the steps of: (a) during a first interval of time, (1) selectively directing contaminated air from the inlet flow structure through the first heat exchange chamber, then to the combustion chamber, then to the second heat exchange chamber, and then to the exhaust fan, and (2) selectively directing processed air from the flush flow structure through the third heat exchange chamber; (b) during a second interval of time following the first interval of time, selectively directing contaminated air from the inlet flow structure through the first heat exchange chamber, then to the combustion chamber, then to the third heat exchange chamber, and then to the exhaust fan; (c) during a third interval of time following the second interval of time, (1) selectively directing contaminated air from the inlet flow structure through the second heat exchange chamber, then to the combustion chamber, then to the third heat exchange chamber, and then to the exhaust fan, and (2) selectively directing processed air from the flush flow structure through the first heat exchange chamber; (d) during a fourth interval of time following the third interval of time, selectively directing contaminated air from the inlet flow structure through the second heat exchange chamber, then to the combustion chamber, then to the first heat exchange chamber, and then to the exhaust fan; (e) during a fifth interval of time following the fourth interval of time, (1) selectively directing contaminated air from the inlet flow structure through the third heat exchange chamber, then to the combustion chamber, then to the first heat exchange chamber, and then to the exhaust fan, and (2) selectively directing processed air from the flush flow structure through the second heat exchange chamber; and (f) during a sixth interval of time following the fifth interval of time, selectively directing contaminated air from the inlet flow structure through the third heat exchange chamber, then to the combustion chamber, then to the second heat exchange chamber, and then to the exhaust fan.

Step (g) of this improved process consists of successively repeating steps (a) through (f) in sequence to maintain a substantially steady state flow of contaminated air through the RTO equipment.

In this improved method, during the second, fourth and sixth intervals of time, the processed air from the combustion chamber is preferably substantially stopped from flowing through the heat exchange chamber which was absorbing heat from the processed air in the previous interval of time.

Also, the first, third and fifth intervals of time are preferably substantially equal to a first length of time, and the second, fourth and sixth intervals are preferably substantially equal to a second length of time. Although the first and second lengths of time need not be the same, they can be made equal if desired, as illustrated in the preferred embodiment of the present invention described below. Although the preferred process described above includes selectively directing processed air through the flow structure in steps (a), (c) and (e), such steps may be omitted if a flush flow structure is not used in the RTO equipment.

A typical flush flow structure will include a main duct and branch ducts in which are located individual flushing valves. These valves are preferably butterfly valves, capable of selectively stopping or allowing the flow of processed air from the high side of the exhaust fan into the chamber to be flushed. The turning off and on of the flushing valves introduces variations in the inlet draw, since the processed air supplied through the flush structure takes the place of some of the air from the plant process. Since in existing RTO systems, the individual flushing valves are cycled on and off, periodic variations are introduced into the inlet draw of the RTO.

To overcome the foregoing problem, there is provided, according to a second aspect of the present invention, an improved RTO apparatus for minimizing pressure variations experienced at the inlet of the RTO. This improvement comprises an automatically-operated balancing valve structure connected to and providing a selectively closable bypass path for air flow between the high pressure and low pressure sides of the exhaust fan. This balancing valve structure includes balancing valve means for selectively substantially closing the bypass path whenever one of the flush valves are directing processed air to one of the heat exchange chambers. The balancing valve means is also for selectively opening the bypass path whenever the flush valve means are not directing processed air to one of the heat exchange chambers. The balancing valve means preferably includes a butterfly valve and an operator mechanism for switching the butterfly valve between its open and closed state in a period of time substantially no longer than the time required for switching the flush valve means between its open state and its closed state.

According to a third aspect of the present invention, there is provided an improved hydraulic control system for minimizing variations in the operation of RTO apparatus due to variations produced by ambient temperature conditions to which the RTO apparatus may be subjected. This improved control system comprises a hydraulic power supply unit with a hydraulic pump, pump drive motor and hydraulic fluid reservoir, a plurality of hydraulically-powered valve operator units, each being for operating a different one of the inlet, outlet and flush valves, supply and return lines for carrying hydraulic fluid under pressure between the hydraulic power supply unit and the valve operator units, means for maintaining the overall temperature of the hydraulic fluid in the hydraulic control system at a substantially constant temperature, and means for regulating flow rates of hydraulic fluid selectively passing through each of several selected valve operator units at a rate that is substantially constant over time for each respective valve operator unit.

The means for regulating the overall temperature includes heating means for increasing the temperature of the hydraulic fluid in the reservoir when it is below a first predetermined temperature. It also includes cooling means for decreasing the temperature of the hydraulic fluid in the reservoir when it is above a second predetermined temperature. Finally, the means for regulating includes insulating means, substantially surrounding the supply and return lines, for minimizing heat transfer between the lines and the ambient environment on account of temperature differences therebetween.

According to a fourth aspect of the present invention, there is provided an improved exhaust stack structure for an RTO equipment for boosting efficiency during a self-cleaning cycle designed to bake off the solid contaminants that may have accumulated within the inlet flow structure of the RTO equipment. This improved exhaust stack structure comprises an elongated, vertically arranged exhaust stack connected to and in fluid communication with the high pressure side of the exhaust fan of the RTO equipment, and damper valve means connected to the exhaust stack for automatically prohibiting entry of a stream of fresh air into the exhaust stack and for automatically allowing heated processed air to escape the exhaust stack. This damper valve means preferably includes a damper structure which is arranged to be closed by gravity and opened by the upwardly-directed stream of processed air arising up the exhaust stack. The degree to which the damper structure is opened is determined by the mass flow rate of processed air arising up the exhaust stack. Since, during the self-cleaning cycle of an RTO, the flow rate is often reduced to about one quarter of normal flow rates, the damper structure need not open very far to allow this reduced flow rate to escape from the exhaust stack. A key advantage of this damper valve structure is that it eliminates an unexpected downwardly-flowing draft of cold air that would otherwise, the Applicant has discovered, wreck havoc on the efficiency of a self-cleaning process explained below.

These and other objects, advantages, aspects and features of the present invention may be further understood by referring to the detailed description, accompanying figures and appended claims.

BRIEF DESCRIPTION OF THE DRAWINGS

The drawings form an integral part of the description of the preferred embodiments and are to be read in conjunction therewith. Like reference numerals designate the same or similar components or features of the various Figures where:

FIG. 3 is a simplified side cross-sectional view of the FIG. 1 apparatus schematically illustrating the inlet, outlet and flush valves and the balancing valve used in the present invention and the fluid communication relationships between these valves and the heat exchange chambers, exhaust fan and exhaust stack;

FIG. 4 is a partial cross-sectional taken through the line 4—4 of FIG. 1 and illustrating the balancing valve and its operator control unit and how this valve is preferably interconnected to the outlet and flush flow structures;

FIG. 9 is a graph depicting the condition (e.g., open, closed, idle or flushing) of each of heat exchange chambers, HEC1, HEC2, and HEC3 through the six intervals of operation A through F depicted in FIGS. 8A through 8F.

DETAILED DESCRIPTION OF THE PREFERRED EMBODIMENT

Figure 1:
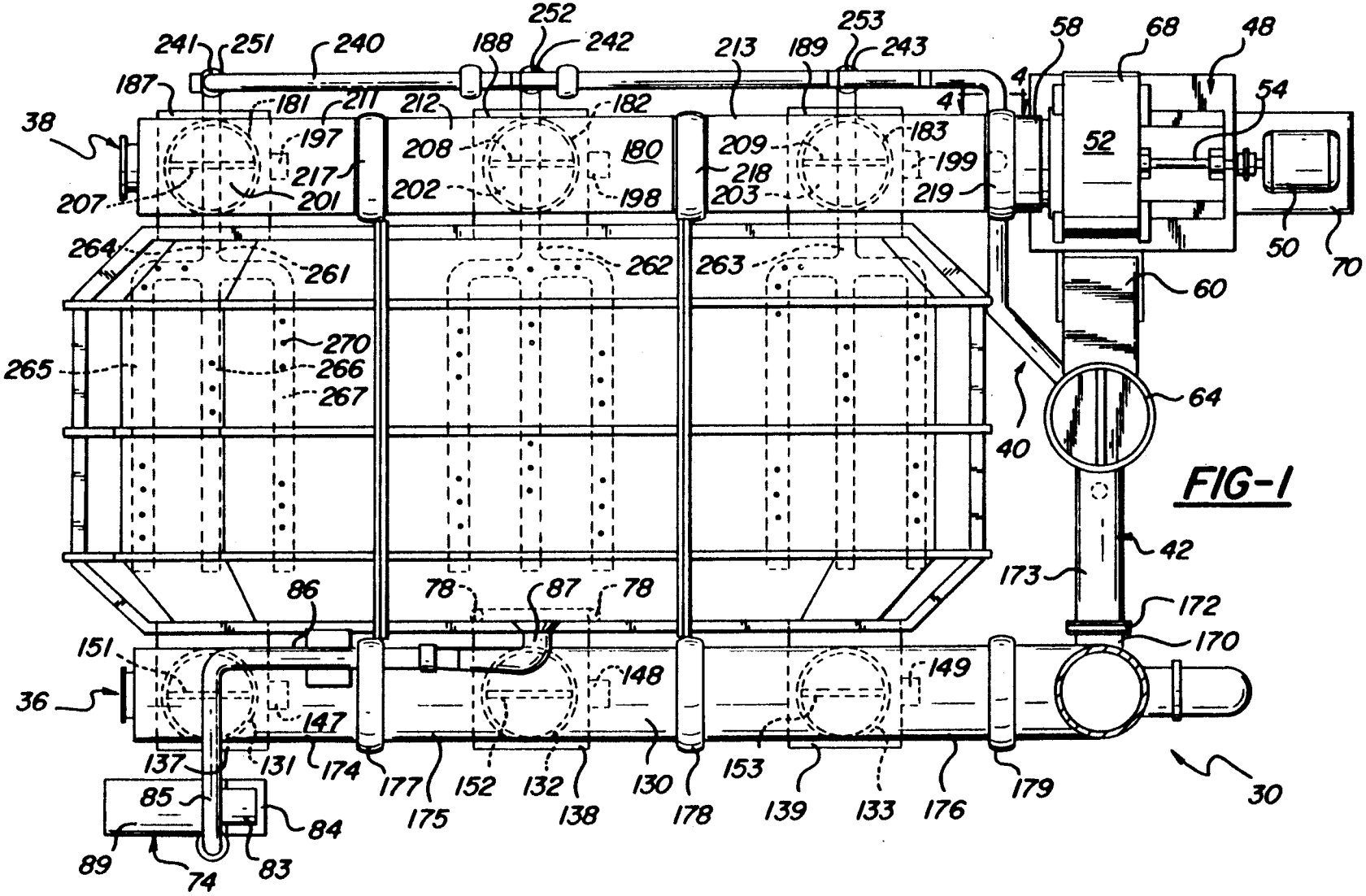
FIG. 1 is a top plan view of the regenerative thermal oxidation apparatus constructed in accordance with the present invention and shown to preferably include three vertically-arranged heat exchange chambers.
Figure 2:
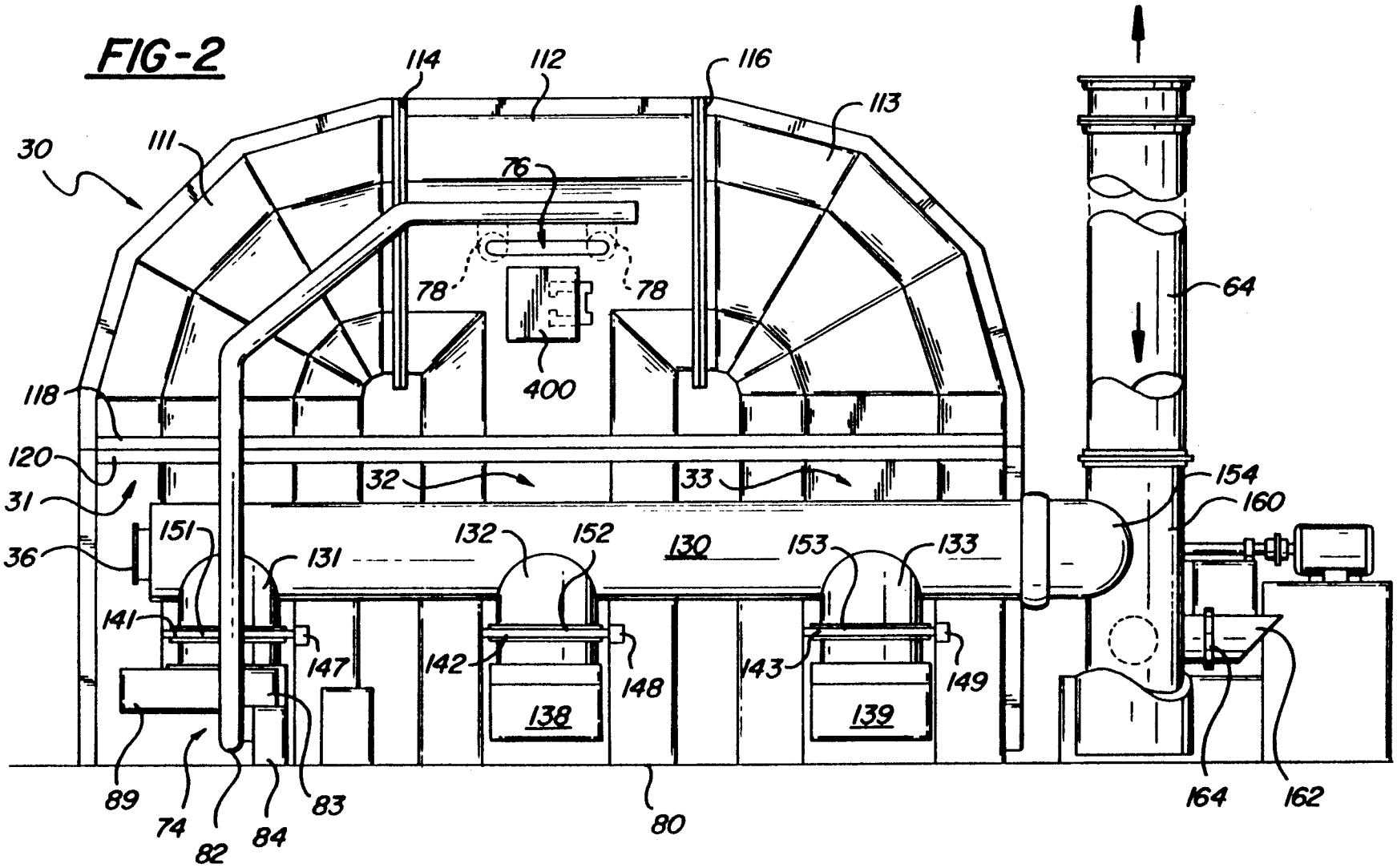
FIG. 2 is a plan view of one side of the regenerative thermal oxidation apparatus of FIG. 1.

FIGS. 1 and 2 show top and plan views, respectively, of a preferred regenerative thermal oxidation ("RTO") system 30 of the present invention. RTO 30 includes three heat exchange chambers 31, 32 and 33 and a common combustion chamber 34 located above chambers 31 through 33. The system 30 also includes an inlet flow structure 36, an outlet flow structure 38, a flush flow structure 40, and a recirculation structure 42. The RTO 30 also includes a centrifugal exhaust fan assembly 48 including a variable speed drive motor 50 coupled to the centrifugal blower fan 52 by a drive shaft 54. In the preferred embodiment, the fan assembly 48 is a 350 horsepower variable speed fan. The low pressure side 58 of the exhaust fan 52 is coupled to one end of the outlet flow structure 38. A high pressure side 60 of the exhaust fan 52 is coupled by a eaves 60 to an exhaust stack structure 64. The centrifugal blower 52 is located on a concrete pedestal 68 and the motor 50 is located on a similar concrete pedestal 70.

RTO 30 also includes a combustion air system 74 which operates in conjunction with a gas supply and burner system 76 (largely not shown) including gas burners 78. The combustion air system 74 further includes a centrifugal air blower 82 including a drive motor 83 which is supported on a concrete pedestal 84. A filter 89 is operatively connected to the air blower 82. It will be appreciated by those skilled in the art, that a cover (not shown) can be incorporated which serves to protect the filter from snow, rain and the like. The air blower 82 is coupled to a first end 85 of a combustion air duct 86. A second end 87 of the combustion air duct 86 is coupled to the combustion chamber 34. In the preferred embodiment, the gas burners 78 are specifically adapted to utilize natural gas. However, alternatively, burners may be incorporated which are adapted to burn oil, propane or the like.

All of the foregoing equipment is supported on the ground or other suitable generally flat surface represented by line 80 in FIG. 2. The various component parts of the foregoing chambers and structures will now be reviewed and the interconnections between the various structures further explained.

Referring now to FIGS. 2 and 3, the construction of heat exchange chambers 31 through 33 will now be explained. The chambers 31, 32 and 33 are constructed of modular chamber housings 101, 102 and 103, each of which may be constructed in octagonal cross-sectional shape as illustrated in FIG. 2 (or any other suitable shape such as hexagonal, cylindrical, rectangular, etc.). Since the internal construction of all three chambers 31 through 33 is identical, only the construction of chamber 31 will be discussed with reference to FIG. 3. The chamber 31 preferably includes a stainless steel corrugated, perforated floor structure 104 supported by suitable steel beams 106 so that saddle rock, other refractory materials or any other suitable heat storage material 108 which allows air to pass through may be disposed on top of the floor 104. In the preferred embodiment, the heat storage material is a bed of saddle rock stones. The bed of material 108 in each chamber 31 through 33 weighs approximately 25 tons.

The combustion chamber 34 is preferably made of three modular pieces 111, 112 and 113, respectively arranged above chambers 31 through 33 and interconnected to each other at vertical flange portions 114 and 116. The flange portions 114 and 116 are interconnected with bolts (not shown). The modular pieces 111 through 113 of the combustion chamber 34 are respectively connected to heat exchange chambers 31 through 33 by flange structures 118 and 120 as best shown in FIG. 2, and similarly interconnected with bolts (not shown).

The inlet flow structure 36 includes horizontally-extending main manifold or duct 130, and branch ducts 131, 132 and 133, respectively connected to chambers 31 through 33 by horizontally-extending duct arms 137, 138 and 139. Within branch ducts 131 through 133 are housed inlet valve structures 141 through 143 controlled by valve operator units 147 through 149, which are preferably commercially available hydraulically-powered cylinders operating a rack and pinion gear reduction mechanism to open and close a butterfly valve located on valve shafts or axles 151 through 153. The inlet valve structure 141 through 143 are conventional and need not be further described. The elbow 154 connects main duct 130 of the inlet flow structure 34 to inlet 156 which receives contaminant-laden air flowing in the direction of arrow 158. Connector duct 160 is supported at the ground and includes fresh air intake duct 162 and fresh air intake butterfly valve 164, which pivots on a valve axle between open and closed positions. The use of this fresh air intake valve 164 is conventional in RTO systems and does not form any part of the present invention, thus need not be further described. For ease of construction, the main duct 130 may be made in three sections 174 through 176 connected at flanges 177 through 179.

As best shown in FIG. 1, the outlet flow structure 38 includes a horizontal main manifold or duct 180, and branch ducts 181, 182 and 183, and horizontal arm ducts 187 through 189 respectively leading to and fluid communication with chambers 31 through 33 through the lower side walls of the chambers. Outlet valve structures 191 through 193 are controlled by valve operator units 197 through 199. These, in turn, cause butterfly valves 201 through 203 to pivot on axles 207 through 209 between open and closed positions. For ease of construction and transport, the main duct 180 may be made in three sections 211 through 213 connected at flanges at 217 through 219.

In the preferred embodiment, inlet flow structure 36 and outlet flow structure 38 are each located substantially the same height off of the ground 80. Preferably, the actuators 147 through 149 and 197 through 199 are approximately 46 inches in diameter, and are located at approximately at an elevation of 4.5 feet for convenient access for maintenance. However, it will be appreciated by those skilled in the art that various configurations may be employed depending on the size of the RTO 30 and the available space.

The flush flow structure 40 is best shown in FIGS. 1, 3 and 4. Structure 40 includes a horizontally arranged main manifold or duct 240 to which are connected branch ducts 241 through 243 in which are located flush valve structures 251 through 253. These are preferably butterfly valves. The flush flow structure 40 also includes horizontal spreader manifolds 261 through 263, each of which resembles a trident spear and extends into its respective heat exchange chamber 31 through 33. As shown in phantom in FIG. 1, this trident-shaped manifold has a first line 264 branching into three arms 265, 266 and 267. The arms 265, through 267 of the manifolds 261 through 263 are perforated with a plurality of holes 270. The holes 270 serve to more uniformly disperse flushing gases throughout the heat exchange chambers 31 through 33, thereby more effectively flushing the chamber, particularly the heat exchange medium 101 through 103 of contaminants. These manifolds 261 through 263 are preferably placed at the lowest portion of the heat exchange chambers 31 through 33. In a preferred embodiment, the lines 264 and arms 265 through 267 are made of twelve inch diameter black pipe, and the holes 270 are about one inch in diameter, and placed at a uniform one another between six to 12 inches apart.

The flush flow structure 40 additionally includes an associated balancing valve structure 280. The balancing valve structure 280, which is further detailed in FIG. 4, includes a valve operator unit 282 which causes a butterfly valve (not shown) to pivot on an axle (not shown) between open and closed positions. The balancing valve is connected at one end to a duct leading to the low pressure side 58 of the exhaust fan 52 and at its other end to a duct leading to the high pressure side 60 of the exhaust fan 52. The balancing valve 280 serves to selectively provide a bypass path for air flow between the flush flow structure 40 and the exhaust fan 48. The balancing valve 280 functions so as to be closed whenever one of the flush valves 251 through 253 is directing flushing gas to its associated chamber 31 through 33 and to be opened when all the flushing valves 251 through 253 are closed. In the preferred embodiment, the flushing lines are all about eight inches in diameter.

The balancing valve structure 280 provides a bypass path for air flow under certain predetermined conditions. The balancing valve structure 280 is connected via a duct which communicates with the exhaust stack 64 at a low pressure region of the exhaust fan. The recirculation valve structure 280 operates for selectively substantially closing the bypass path whenever any of the flush valves 251 through 253 are directing processed air to one of the heat exchange chambers 31 through 33. The balancing valve structure 280 further operates to open the bypass path whenever any of the flush valves 251 through 253 are closed thereby prohibiting processed air to enter the heat exchange chambers 31 through 33. The balancing valve structure 280 provides means for selectively recirculating processed air from the high pressure side of the exhaust fan to the low pressure side of the exhaust fan.

The recirculation flow structure 42, as best shown in FIGS. 1 and 2 includes a horizontal duct 174 in communication with horizontal duct 170 which communications with connector duct 160. The other end of horizontal duct 174 is connected to the lower end of the exhaust stack structure 64. Horizontal duct 174 includes an flange recirculation valve structure 280. The recirculation valve structure 280 includes a valve operator unit (not shown) which causes a butterfly valve (not shown) to pivot on an axle (not shown) between opened and closed positions.

In the preferred embodiments, the balancing valve structure 280 includes a butterfly valve 300 and an operator mechanism 302 for switching the butterfly valve 300 between an open state and its closed state. The switching of the butterfly valve 300 between its open state and closed state occurs in a period of time substantially no longer than the period of time required for switching the flushing valves 251 through 253 between their respective open states and closed states. When operated in this manner, the balancing valve structure 280 provides substantially constant flow characteristics across the exhaust fan at any given normal operating point of the exhaust fan, even as the inlet valves, outlet valves and flushing valves operate. Preferably, the operator unit which opens and closes the butterfly valve is hydraulically-powered.

Figure 7:
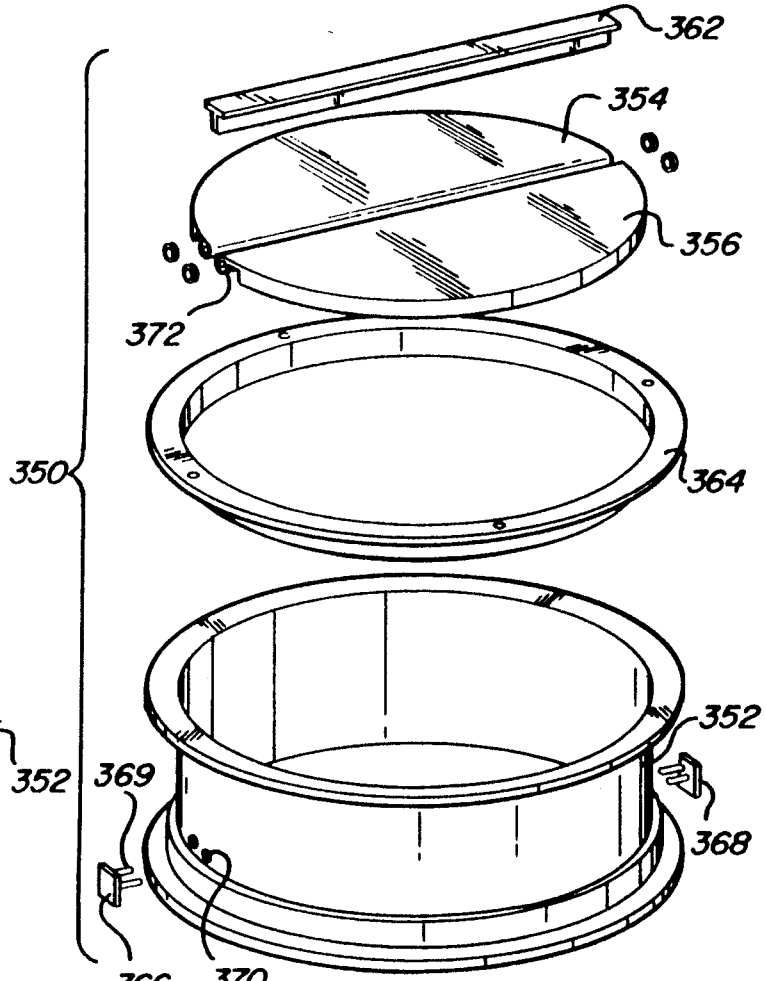
FIG. 7 is an exploded view of the gravity-actuated damper valve structure shown in FIGS. 5 and 6, showing details of the valve's construction.
Figure 5:
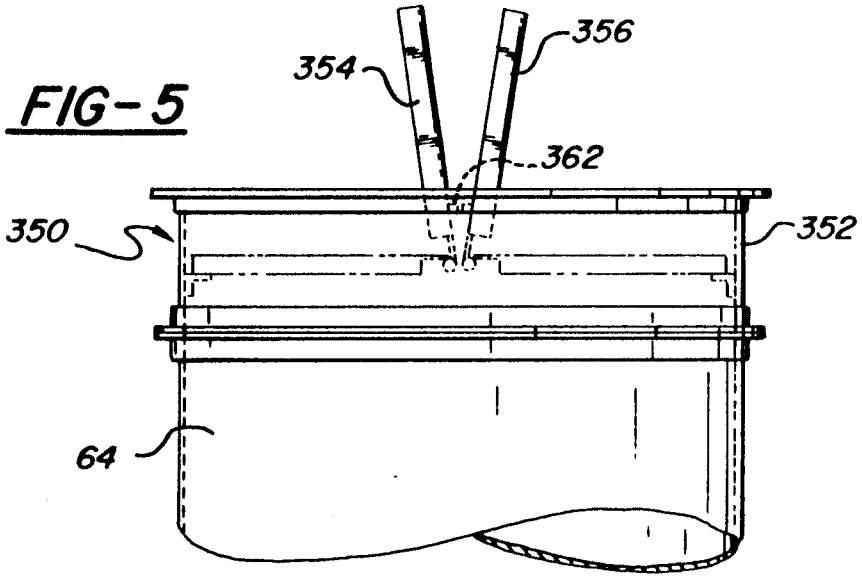
FIG. 5 is a front view of the top of the exhaust stack as viewed from broad arrow 5 shown in FIG. 2, showing a gravity-actuated bifurcated damper valve in its open position and showing with phantom lines its closed position.
Figure 6:
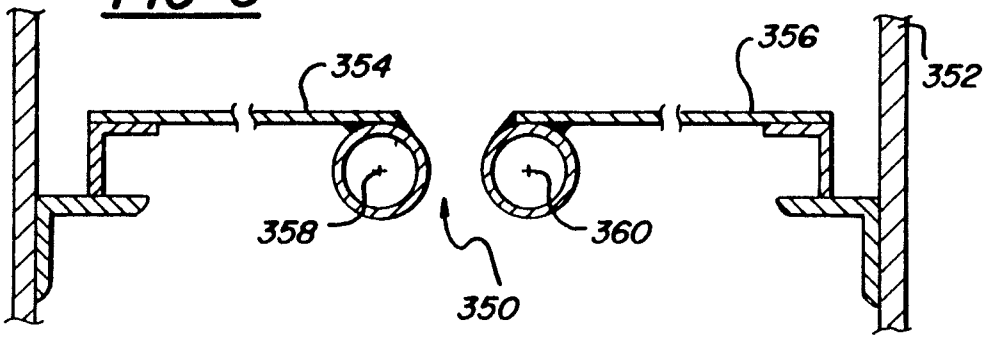
FIG. 6 is an enlarged fragmentary cross-sectional view of the gravity-actuated damper valve structure of FIG. 5.

Referring to FIGS. 5 through 7, illustrated is the damper valve means 350 of the present invention. In the preferred embodiment, the damper valve means 350 is a gravity-actuated damper valve structure which is connected to the exhaust stack 64 for automatically prohibiting entry of a stream of fresh air into the exhaust stack 64 and for automatically allowing heated processed air to escape the exhaust stack 64. The gravity-actuated damper valve structure 350 is arranged so as to be closed by gravity, and opened as far as may be needed by an upwardly-directed stream of processed air rising up the exhaust stack 64. The damper structure 350 is mounted within the exhaust stack 64, the damper structure 350 includes a housing 352 which is mounted to the exhaust stack 64. The damper structure 350 further includes a pair of semi-circular plates 354, 356. Each plate 354, 356 is mounted for pivoting motion about an axis 358, 360 (as shown in FIG. 6). The axes 358, 360 of the plates 354, 356 are arranged substantially adjacent to one another. Disposed between the two semi-circular plates 354, 356 is a travel bar 362 which is substantially T-shaped in cross-section. As particularly shown in FIG. 5, the travel bar 362 limits the travel of plates 354, 356 so as to prohibit each of the plates from pivoting to a fully-upright position in which would no longer be affected by gravity. In other words, heated exhaust gases coming out of the exhaust stack 64 are able to pivot the semi-circular plates 354, 356 only so far as permitted by the travel bar 362. As the exhaust gases are reduced in volume, the semi-circular plates 354, 356 will pivot towards their closed position (as shown in FIG. 6). The damper structure of the present invention further includes a sealing ring 364 which is welded to the housing. Pivot structures 366 and 368, having two pivot pins or prongs 369, pass through apertures 370 formed in the housing 352. The prongs 369 of the pivot structures 366, 368 extend into a circular cavity 372 formed in each of the semi-cylindrical plates 354, 356.

For ease of construction and transport, the RTO 30 of the present invention is assembled from six major modular components. These include the three heat exchange chambers 31 through 33 and the three modular pieces 111, 112 and 173 which are assembled to form the combustion chamber. The heat exchange chambers 31 through 33 and the modular pieces 111 through 113 all have their external walls lined with a conventional soft shell heat retention material (not shown), which is preferably at least eight inches thick. All of the ductwork in the RTO 30 is also insulated either internally or externally with four to eight (or more) inches of conventional light-weight substantially inert insulating material. The soft shell-lined chambers of the present system for a well-insulated, energy-efficient system capable of providing continuous operating temperature in excess of 2,200° Fahrenheit. The soft lining is not subject to cracking as a consequence of thermal expansion or shock. It does not spall as does refractory material, such as concrete or brick, the possible emission of resulting dust into the exhaust stack is eliminated. Additionally advantageous, the soft shell material allows the large components of the apparatus to be lined with this insulating material prior to being shipped from the manufacturer's factory to the customer's site, thereby reducing installation time.

As shown in FIG. 2, the modular piece 112 which forms part of the chamber 34 is formed to include an access door 380. The access door is designed to be airtight. It provides access to the gas control enclosure (largely not shown) which houses the burners 78 and gas train components (not shown) for maintenance purposes. In the preferred embodiment, the access door 380 is both hinged and articulated, to thereby facilitate ease of motion.

Figure 10:
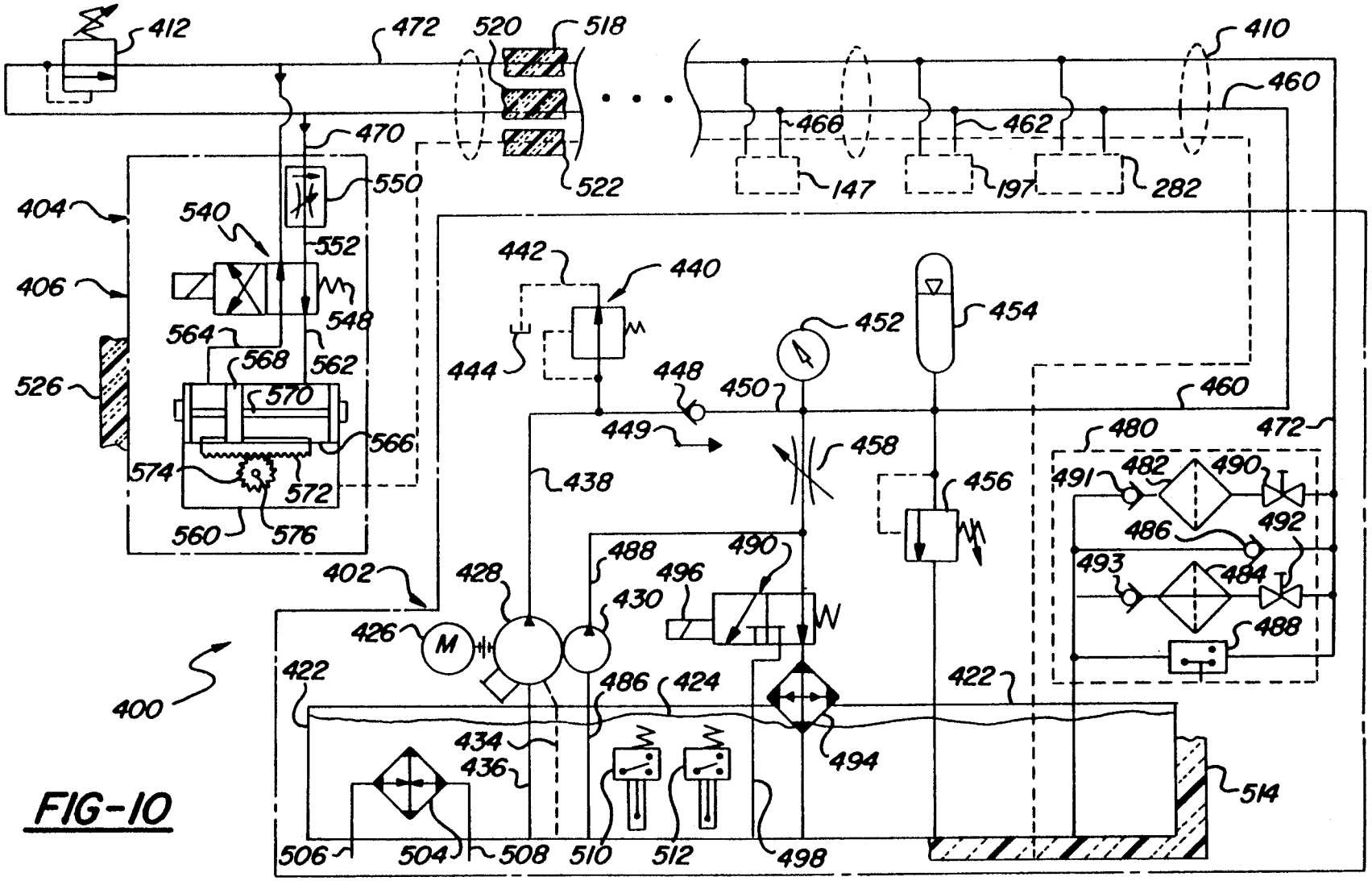
FIG. 10 is a partial schematic diagram of the hydraulic control system of the present invention showing those improvements used to achieve stable long-term operation of the FIG. 1 RTO apparatus.

FIG. 10 schematically illustrates a preferred hydraulic control system 400 of the present invention used with RTO 30. Hydraulic system 400 includes a hydraulic power supply unit 402 and a group 404 of all of the hydraulically-powered valve operator units used on RTO 30, such as are illustrated by unit 406 which operates the balancing valve structure 280, and other representative valve operator units in FIG. 10. These other units in FIG. 10 are valve operator unit 147 used to drive with the first inlet valve 131, valve operator unit 197 used to drive the first outlet valve 181, and valve operator unit 282 used to drive the first flush valve 241. It should be understood that, from the ellipses 407, although not shown, all of the other valve operator units of RTO 30 are also operated by system 400. Since the internal construction of these valve operator units 406, 147, 197 and 282 are identical in terms of type of components and operation (but not necessarily size), only the internal structure of valve operator unit 406 is shown. The hydraulic system 400 also includes a group 410 of supply, return lines and drain lines for carrying hydraulic fluid between the hydraulic power supply unit 402 and the valve operator units. Finally, the hydraulic system 400 may include one or more pressure reducing valves 412 for clipping hydraulic pulsations, such as those created by the hammering effect of a moving column of hydraulic fluid being brought to an abrupt stop by the closure of an automatically-operated hydraulic valve. Armed with this overview, the component parts of the hydraulic system 400 will now be explained.

The hydraulic power supply unit 402 includes an appropriately-sized hydraulic reservoir 422 filled with hydraulic oil or other conventional hydraulic fluid indicated by numeral 424. Power supply unit 402 also includes an electric motor 426 which drives a main hydraulic pump 428 and auxiliary hydraulic pump 430. Main hydraulic pump includes a volume adjustment mechanism 432 and drain line 434. Oil is drawn through suction line 436 into the pump 428 and is provided to conduit 438. System over-pressure is prevented by hydraulic relief valve 440, which has a return drain line 442 to the tank or reservoir represented by symbol 444. Check valve 448 allows hydraulic fluid from the pump to flow only in the direction indicated by arrow 449. Pressurized hydraulic fluid is delivered via conduit 450 to several portions of the hydraulic circuit, including pressure gauge 452, accumulator 454, adjustable pressure relief valve 456 which is set to control the normal system pressure, and adjustable needle valve 458.

Line 450 also delivers the supply of pressurized hydraulic fluid to main supply line or conduit 460, which supplies pressurized hydraulic fluid to each of the group 404 of operator control units through individual lines 462 through 470. The main return line 472 is connected to the surge-reducing valve 412 and is also connected to a return line filter assembly 480. Drain line 474 provides a path of oil internally leaking within the valve operator units to return to reservoir 422. The assembly 480 includes a pair of return line filters 482 and 484, spring-loaded bypass check valve 486 and a bypass pressure switch 488 to indicate when the return line filters are being bypassed through check valve 486. Also, manual shut-off valves 490 and 492 and check valves 491 and 493 are provided to facilitate on-line replacement of dirty filter elements. This arrangement for return line filter assembly 480 is conventional and need not be further described.

The auxiliary hydraulic pump 430 draws oil through its suction line 486 and supplies it through pressurized line 488 to solenoid-operated two-position, spring-returned control valve 490. Valve 490 is preferably normally-open, as shown. When in this state, valve 490 delivers oil from line 488 to oil cooler 494. Cooler 494 may be an oil-to-air heat exchanger, water-cooled heat exchanger, or refrigerant-cooled heat exchanger. An air-cooled heat exchanger is preferred, since the water connections or electrically-operated refrigerant-based unit would involve additional cost. Solenoid operator 496 of valve 490 can, when desired, switch valve 490 so that pressurized oil from line 488 is diverted to tank line 498, thus bypassing the cooler 494. Those in the art will appreciate that by controlling when solenoid 496 is energized, oil may be selectively directed through heat exchanger 494 in order to cool off the temperature of the fluid within the reservoir 422.

Heater 504 is shown in the lower left part of reservoir 422. Preferably, heater 504 is electrically-powered, but may be powered using steam or any other suitable source of heat. Electrical power may be applied selectively, as desired, for example, through electrical wires 506 and 508, thus raising the temperature of the oil in the reservoir 422. The temperature of the fluid 424 is sensed by adjustable temperature switches 510 and 512, which produce appropriate on-off electrical signals that can be used by conventionally-designed electrical control system (not shown) to energize the various solenoids used in RTO 30. In operation, the oil in reservoir 422 is heated to a preferred temperature range as 110° to 115° Fahrenheit. If the oil temperature should be below the lower set point temperature, electric heater 504 is used to increase the oil temperature. If the oil temperature exceeds the upper set point temperature, solenoid 496 is de-energized so that oil from pump 430 will be forced through heat exchanger 494, thus cooling the oil down to within the desired temperature range by keeping the hydraulic oil temperature within a predetermined close tolerance, i.e., a preferred range of temperatures, stable hydraulic-powered operation of the valve operator units 404 within system 400 can be assured, even as ambient temperature changes drastically, for example, between temperature extremes experienced by day and night, and from season to season.

In order to reduce further the impact of ambient temperature conditions, thermal insulation is preferably added to the exterior surfaces of the hydraulic tank. This insulation is represented by a pad or blanket of insulation 514, which preferably extends all the way around the outer surface of reservoir 422. Also, the hydraulic supply lines 472 may be insulated completely using individual elongated pieces of cylindrical insulation or other conventional or suitable insulation products for piping. This insulation of the supply, return and drain lines is indicated by representative insulation material found on these lines at locations 518 through 522. Similarly, each of the hydraulically-powered valve operator units, such as unit 406 may be insulated with a blanket of insulation material, if desired, such as is indicated by material 525.

The accumulator 454 is preferably an air-over-oil accumulator as shown. It is used in order to smooth out variations in hydraulic pressure caused by the cycling of the directional control valves within the valve operator units. This helps further ensure smooth transitions of the butterfly valves of the RTO unit 30 between their opened and closed positions. Also, the accumulator is preferably sized to provide sufficient stored energy (in the compressed gas) to drive all of the butterfly valves to their opened position during an electrical power failure. Adjustable needle valve 458 is preferably adjusted to ensure that a small amount of the total amount of oil delivered through pressurized line 438 and check valve 448 flows through valve 458. This helps to prime pump 430 upon start-up and also helps cool off oil when the control valves are not cycling.

In FIG. 10, the typical valve operator unit, represented by unit 406, will now be explained. The valve operator unit includes a solenoid-actuated, two-position, four-way, spring-returned directional control valve 540. Valve 540 includes an electrical solenoid operator 546 and return spring 548. Unit 406 also includes a pressure and temperature compensated flow control valve 550 located in series with valve 540. The output ports of valve 540 are connected to a linear-to-rotary actuator 560 via lines 562 and 564. The actuator 560 includes a hydraulic cylinder 566 having a piston 568 which is suitably supported for linear travel such as by being slidably mounted along centrally-located support rod 570. Connected to part of the piston 568 is a rack 572 with gear teeth that mesh with pinion gear 574. The pinion gear, in turn, directly drives (or through a gear reducer, not shown), drives the axle shaft of a butterfly valve.

In operation, valve operated unit 406 drives its associated butterfly valve into one state (for example, opened) when solenoid 546 is de-energized. When solenoid 546 of valve 540 is energized, the valve directs pressurized hydraulic fluid to the opposite side of piston 568, which causes the butterfly valve to switch to its closed state (those in the art will appreciate that this design could be reversed, so that the butterfly valve is closed when the solenoid is de-energized, if desired). The temperature and pressure-compensated flow control valve 550 serves to precisely control the rate at which the piston 568 is allowed to switch from one extreme position to the other extreme position, since the valve 550 regulates flow bidirectionally. This operator control unit 406 takes the same amount of time to switch its associated butterfly valve from fully opened to fully closed as it does to switch it from fully closed to fully opened. In the preferred embodiment of RTO 30, the hydraulically-driven butterfly valve is switched in two seconds or less. By manual adjustments to the flow control valve 550 found at each of end valve operator units, the flows into each operator unit may be regulated so that the butterfly valves take approximately the same amount of time (e.g. two seconds) to switch between states. Having the ability to precisely adjust the speed at which the butterfly valves of RTO 30 are opened and closed, is a significant advantage of the present invention. This ability allows the various pairs of butterfly valves being switched together to be switched at precisely the same rate of speed. This, in turn, is important in order to eliminate air pressure pulsations at the inlet of the RTO 30 due to butterfly valve transitions. In turn, this has been found to be important in order to precisely maintain the virtually constant mass flow rates through the RTO unit 30 constant, even though flow reversals are taking place. Those skilled in the art will appreciate that the well-insulated, temperature-controlled and temperature compensated hydraulic control system 400 of the present invention enables RTO 30 to be operated with substantially constant mass flow rates even though extreme swings in ambient temperature conditions are being experienced.

The overall operation of the RTO 30 of the present invention as a regenerative incineration system is best understood with reference being particularly made to FIGS. 3, 8 and 9. In FIGS. 8A through 8F, the flow path of contaminated air in the combustion chamber 34 is represented by the broad dashed arrow. The thin dashed arrow represents flow path of the flushing air which is supplied by the flush air structure 40. With regard to FIG. 8, it will be appreciated that the ductwork and valves within the flow structures are shown in simplified schematic form. The preferred orientation of the flow structures is depicted in FIGS. 1 and 2. In FIG. 8, the darkened heavy lines represent air flow paths. Accordingly, valves located within air flow paths are shown in their opened position (permitting air flow), parallel to the direction of the flow. The closed valves are illustrated perpendicular to the corresponding duct. The RTO 30 is designed for continuous operation except for periods of shut-down, such as those which occur at plants during holidays, weekends or the like. The RTO 30 operates continuously to oxidize a source of contaminated air, by repeatedly cycling through six different operating states or steps. Each state has its own particular air flow configuration, which is established by the settings of various valves to their opened or closed positions, as explained below and shown in FIG. 8. Each state of this six state, six-step sequence lasts for a predetermined period of time. The length of time for each state may be adjusted as desired through the electrical control system. The use of adjustable timers for process control is well-known and need not be described here.

Figure 8A:
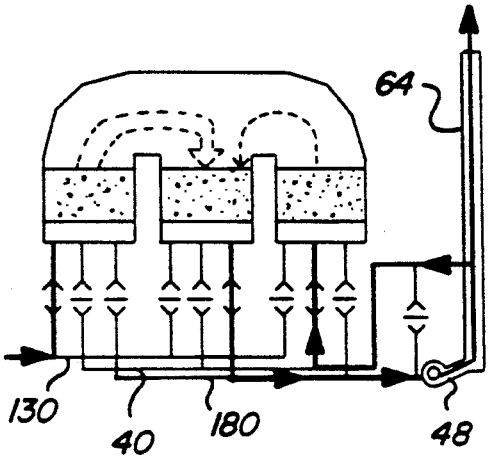
FIGS. 8 is a set of six simplified cross-sectional schematic flow diagrams labeled FIG. 8A through FIG. 8F illustrating the various states of the inlet, outlet and flush valves and the balance valve of the RTO apparatus in FIG. 1, when operated in accordance with a preferred six-step method of the present invention.

FIG. 8A shows the first state, state A, which occurs during a first interval of time. In this first state, the inlet valve 141, associated with the first heat exchange chamber 31 and the outlet 192, associated with the second heat exchange chamber 32, are opened so as to permit a source of contaminated air to be selectively directed through the first heat exchange chamber 31 to the combustion chamber 34 and then to the second heat exchange chamber 32 and then to the exhaust fan 48. Simultaneously, the inlet valve 143 associated with the third chamber 33 is closed. Also during the first interval of time, the flush flow valve 253 associated with the third heat exchange chamber 33 is opened so as to permit flushing gases to pass from the main conduit 240 into manifold 264, and uniformly disperse flushing gases throughout the third heat exchange chamber 33 and the balancing valve 280 is closed. The other valves shown in FIG. 8A are closed (or are left in their closed state), which prevents air flow through respective branch ducts.

Figure 8B:
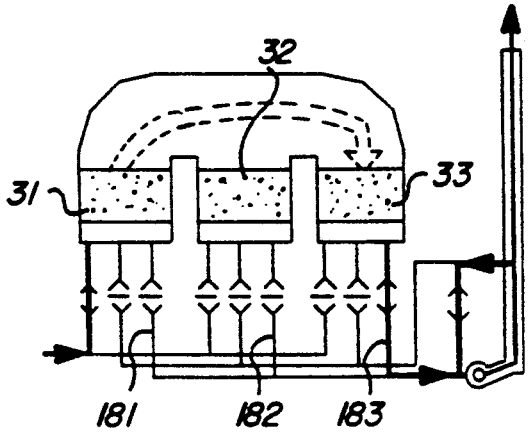

FIG. 8B shows the second state, state B, which occurs during a second interval of time. At the beginning of this interval, following the first interval of time, the inlet valve 141 associated with the first heat exchange chamber 31 remains open, the outlet flow structure valve 193 associated with the third heat exchange chamber 33 is opened, and the outlet valve 192 associated with the second chamber 32 is closed, so as to selectively direct a source contaminated air into the first heat exchange chamber 31, through the combustion chamber 34 and out of the third heat exchange chamber 33. Also, during the second state, the flushing valve 253 associated with the third chamber 33 is closed while the balance valve 280 is opened.

Figure 8C:
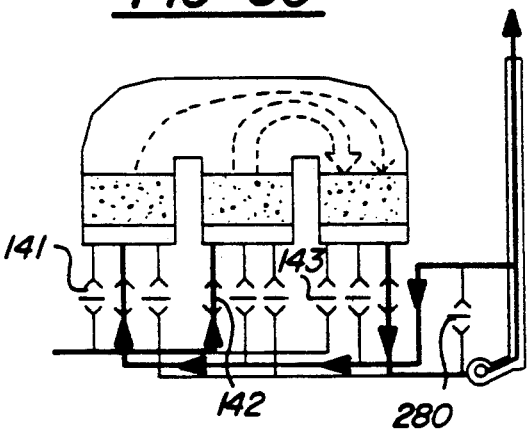

FIG. 8C shows the third interval of time, or state B, which occurs following the second interval of time. During the third interval, the inlet valve 192 associated with the second heat exchange chamber 32 is opened, outlet valve 193 associated with the third heat exchange chamber 33 remains open, and the inlet valve 141 associated with the first chamber 33 is closed, so as to selectively direct contaminated air into the second heat exchange chamber 32 through the combustion chamber 34 and out the third heat exchange chamber 33. Also during the third interval of time, the flush valve 251 associated with the first heat exchange chamber 31 is open so as to selectively direct a source flushing gases through the first heat exchange chamber 31 to the combustion chamber 34 and out of the second heat exchange chamber 32 and the balancing valve 280 is closed.

Figure 8D:
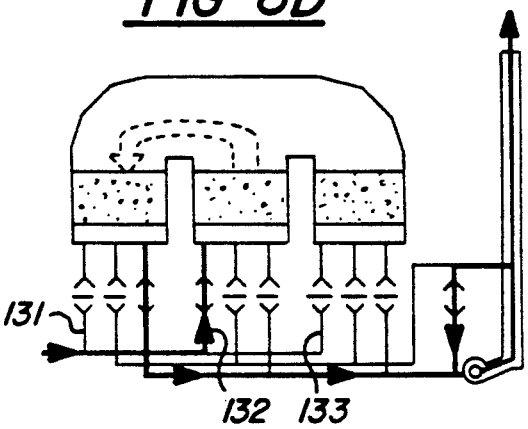

FIG. 8D shows the state of the RTO's values during a fourth interval of time (as shown in FIG. 8D) following the third interval of time. In state D, the inlet valve 132 associated with the second heat exchange chamber 32 remains open, the outlet valve 191 associated with the first heat exchange chamber 31 is opened, and the outlet valve 193 associated with the third chamber is closed, so as to selectively direct a source contaminated air to enter the second heat exchange chamber 32, pass through the combustion chamber 34 and exit the first heat exchange chamber 31. Also, during this state, the flushing valve 251 associated with the first chamber 31 is closed while the balancing valve 280 is opened.

Figure 8E:
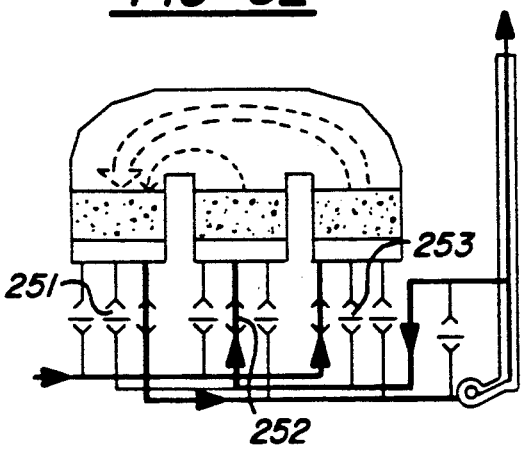

FIG. 8E represents during a fifth interval of time, or state E, which follows the fourth interval of time. During this fifth interval, the inlet valve 133 associated with the third heat exchange chamber 33 is opened, the outlet valve 191 associated with the first heat exchange chamber 31 remains open, and the inlet valve 142 associated with the second chamber 32 is closed so as to direct a source contaminated air to enter the first heat exchange chamber 33, pass through the combustion chamber 34 and exit the first heat exchange chamber 31. Also, during the fifth interval of time, the flush valve 252 associated with the second heat exchange chamber 32 is open so as to permit flushing gas to rid the bed of refractory material 108 in the second heat exchange chamber 32 of contaminants and the balancing valve 280 is closed.

Figure 8F:
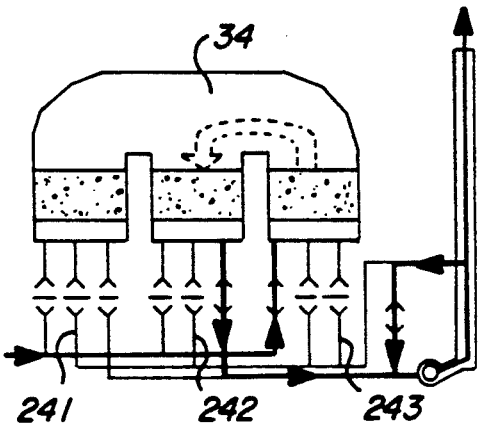

FIG. 8F shows state F, which occurs during a sixth interval of time following the fifth interval of time (as shown in FIG. 8E). In state F, the inlet valve 141 associated with the third heat exchange chamber 33 remains open, the outlet valve 192 associated with the second heat exchange chamber 32 is opened, and the outlet valve 191 associated with the first chamber 31 is closed, so as to selectively direct a source contaminated air to pass through the bed of refractory material 108 located in the third heat exchange chamber 33, through the combustion chamber 34 and out the second heat exchange chamber 32. Also during this state, the flushing valve 252 associated with the second chamber 32 is closed while the balancing valve 280 is opened.

During the first, third and fifth intervals of time, two sources of air, namely, the contaminated air and the flushing gases are selectively directed so as to exit through a single heat exchange chamber (as shown in FIGS. 8A, 8C and 8E). During the second, fourth and sixth intervals of time, flushing gases are not directed through the chambers 31 through 33 (as shown in FIGS. 8B, 8D and 8F). In order to maintain a flow of air having constant characteristics across the exhaust fan 52, the balancing valve 280 is opened when all of the flush valves, 251 through 253, are closed. The flush flow structure 40, through the balancing valve 280, selectively recirculates processed air from the high pressure side of the exhaust fan 52 to the low pressure side of the exhaust fan 52, thereby maintaining a constant volume of air across the exhaust fan 52 throughout the six time intervals.

The first, third, and fifth intervals of time (FIGS. 8A, 8C and 8E) are all the same length, preferably in the range of 10 to 20 seconds, with about 20 to 60 seconds for each interval of time being preferred. The second, fourth and sixth intervals of time (FIGS. 8B, 8D and 8F) are preferably in the range of five to 60 seconds, with about 10 to 30 seconds being preferred. Those skilled in the art will appreciate that the length of time that the flush valves 251 through 253 remain open in directly related to the size of the flush lines. As the flush line sizes are increased, the length of time devoted to flushing a heat exchange chamber may be reduced accordingly.

In one preferred embodiment of the present invention, all six intervals of times were set equal to 20 seconds. Those in the art will appreciate that other times (such as 10 to 60 seconds per interval) may also be used without significant change in the performance of the RTO 30.

In the preferred embodiment of the present invention, the valve operator units are capable of switching each of the inlet, outlet and flush valves and the balance valve 280 from one state to the other (open to closed, closed to open) in about two seconds. While one of the inlet valves is opening, for example, another of the inlet valve is closing. Similarly, while one of the outlet valves is opening, another of the outlet is closing. This synchronous mode of operation of pairs of inlet valves and pairs of outlet valves ensures that a substantially uniform flow rate is maintained. Similarly, as each flush valve changes state, the balance valve is similarly changing to an opposite state. This also helps ensure that equal flow rates are maintained through the flush flow structure 40, whether the processed air is being directed through a flush valve or through the balancing valve 280. In summary, the synchronized symmetrical operation of the various valves within the system is believed to contribute to maintaining a substantially steady-state flow condition in spite of the periodic changes of states of the valves and the periodic air flow reversals through the various heat exchange chambers 31 through 33.

FIG. 9 illustrates in more compact form, the state of each of the heat exchange chambers 131, 132 and 133 (designated in FIG. 9 as C1, C2 and C3, respectively) during the six state or time intervals A through F. For example, chamber 131 (C1) is in a heat-releasing mode during states A and B, since incoming contaminated air from the inlet flow structure is being routed through chamber C1 during the states. During state or time intervals C1 is being filled with processed air from the exhaust stack to flush it of any contaminated air which remained in the chamber at the end of time interval B. During states D and E, chamber C1 is in a heat-absorbing mode, since gases from the combustion chamber 34 are flowing through it to the outlet flow structure. During state or time interval F, chamber C1 is idle, that is no gases are flowing through it. Based upon the discussion with respect to chamber C1, the rest of the table in FIG. 9 will be readily understood. Those in the art should appreciate that, as in earlier RTOs, RTO 30 operates by exhaust fan 52 producing a negative pressure region on its inlet side. This low pressure region, which is slightly below atmosphere, thus produces a negative pressure in the outlet flow structure, which, in turn, produces a negative pressure in the chamber to which the outlet flow structure is connected. The gases in the combustion chamber 34 see this negative pressure and are drawn to the heat exchange chamber having negative pressure. This, in turn, causes gases in the heat exchange chamber connected to the inlet flow structure to move toward the combustion chamber, thus drawing air in from the inlet flow structure.

The RTO 30 includes a bake-out cycle. The bake-out cycle operates like a self-cleaning oven, and used to get rid of the build up of solid solvent residue or other contaminants on the flow structure and heat storage media and associate support beds of heat chambers 31 and 33 of the RTO. During the bake-out process, dampers (not shown) located farther upstream at the process equipment are shut, and the recirculation valve 172 is opened fully. During the bake-out cycle, the exhaust fan is typically run at about 25 percent of its normal speed since the combustion gas are simply being re-circulated.

When the RTO 30 is operated in its bake-out cycle as described above without the gravity-actuated damper valve structure 350 in the exhaust stack 64, the inlet temperatures have been found to reach only a maximum of 700 degrees or so. Such a bake-out cycle may require up to twenty-four hours or more to complete. However, even with inlet air temperatures at 700° Fahrenheit, bake-out occurs, but only much slower rate than it would at higher inlet temperatures, such as 875 degrees.

In my investigation of the bake-out cycle, I found that processed air being exhausted by the main fan 68 into the exhaust stack 64 created a stream of air up the exhaust stack, which may be fifty feet or more in height in a typical RTO. This upward draft of air also produced a down draft of relatively cold air, thus materially lowering the overall temperature of air existing at the bottom of the stack where the recirculating gases are drawn from by recirculation structure 42.

The gravity-actuated damper structure 350 on the exhaust stack 64 substantially eliminates this down draft. It is expected that, with 875° to 900° temperature air in the bottom of the stack 64 now being available for delivery to the inlet flow structure 36, the temperatures in the inlet flow structure will reach about 875° (or more) during the bake-out cycle of the RTO. It is expected that this will materially reduce the overall time required to achieve complete bake-out, which, in turn, will reduce energy consumption required to complete a bake-out cycle.

The foregoing detailed description illustrates the preferred embodiment of the present invention are well-suited to fulfill the objects above-stated. It is recognized that those skilled in the art may make various modifications or additions to the preferred embodiment and preferred methods, beyond those already described above, without departing from the spirit and proper scope of the present invention. This is particularly true in that the specific configuration used for the RTO equipment of present invention is primarily dictated by space requirements. In other words, many of the structural components incorporated in the preferred embodiments can be readily replaced with equivalents to accomplish substantially the same result. For example, a structural configuration for the heat exchange chambers or combustion chamber may be employed, such as substituting horizontally-arranged chambers for the vertically-arranged chambers. In addition, a greater number of heat exchange chambers may be used. Accordingly, it is to be understood that the protection sought and to be afforded hereby should be deemed to extend to the subject matter defined by the appended claims, including all fair equivalents thereof.

I claim:

1. An improved regenerative thermal oxidation ("RTO") apparatus for purifying a contaminated source of air of the type including (1) at least first, second, and third heat exchange chambers, each chamber having a first end and a second end and containing refractory heat exchange media through which the contaminated air may be drawn;

(2) an exhaust flow structure including an exhaust duct and exhaust fan means connected to the exhaust duct, for pushing processed air into the exhaust duct, thereby creating a low pressure region upstream of the exhaust fan means;

(3) an inlet flow structure having an inlet connectable to a source of contaminated air, and inlet valve means for selectively directing a source of contaminated air to be processed into the first end of each one of the heat exchange chambers at different intervals of time;

(4) a flush flow structure connected to and in fluid communication with the exhaust duct and having flush valve means for selectively directing processed air from the flush flow structure to the first end of each one of the heat exchange chambers at different intervals of time;

(5) an outlet flow structure connected to the low pressure region of the exhaust fan means and having outlet valve means for selectively directing contaminated air out of the second end of each one of the heat exchange chambers to the outlet flow structure at different intervals of time; and (6) a combustion chamber common to and in fluid communication with the second end of each heat exchange chamber;

the improvement being for minimizing pressure variations experienced at the inlet of the inlet flow structure, and comprising:

a balancing valve structure, connected between and providing a bypass path for air flow between the flush flow structure and the low pressure region of the exhaust fan means, including balancing valve means for selectively substantially closing the bypass path whenever the flush valve means are directing processed air to one of the heat exchange chambers, and for opening the bypass path whenever the flush valve means are not directing processed air to one of the heat exchange chambers.

2. The improved RTO apparatus of claim 1, wherein the balancing valve means includes a butterfly valve and an operator mechanism for switching the butterfly valve between its open state and its closed state in a period of time substantially no longer than the period of time required for switching the flush valve means between its open state and its closed state.

3. An improved regenerative thermal oxidation ("RTO") apparatus of the type having a plurality of heat exchange chambers in which thermal storage material is located and through which gases to be oxidized pass, a plurality of valve mechanisms connected to inlet, outlet and flush flow structures for selectively directing gas flow to and from the heat exchange chambers and an exhaust duct, and exhaust fan means, having a low pressure side connected to the outlet flow structure and a high pressure side connected to the exhaust duct, for drawing gases to the outlet flow structure from the heat exchange chambers and for pushing the gases into the exhaust duct, the improvement being for providing substantially constant flow characteristic across the exhaust fan means at any given normal operating point of the exhaust fan means even as the valve mechanisms operate, the improvement comprising:

a bypass conduit structure interconnecting the exhaust duct, the flush flow structure and the outlet flow structure, and valve means disposed at least partially within the bypass conduit structure for selectively regulating the flow capacity of the bypass conduit structure to compensate for variations in flow rate through the exhaust fan means produced by the flush flow structure alternately starting and stopping flush flow while the RTO apparatus cycles gases to be oxidized through the plurality of heat exchangers.

4. The improved RTO apparatus of claim 3, wherein the valve means includes a butterfly valve and a hydraulically-powered operator unit which opens and closes the butterfly valve.

5. In a regenerative thermal oxidation ("RTO") apparatus for purifying a contaminated source of air of the type including (1) at least first, second, and third heat exchange chambers, each chamber having a first end and a second end and containing refractory heat exchange media through which the contaminated air may be drawn;

(2) an exhaust structure including an exhaust duct and exhaust fan means connected to the exhaust duct, for pushing processed air into the exhaust duct, thereby creating a low pressure region upstream of the exhaust fan means;

(3) an inlet flow structure having an inlet connectable to a source of contaminated air, and inlet valve means, including at least three separate, independently-operable inlet valves, for selectively directing a source of contaminated air to be processed into the first end of each one of the heat exchange chambers at different intervals of time;

(4) a flush flow structure connected to and in fluid communication with the exhaust duct and having flush valve means, including at least three separate, independently-operable flush valves, for selectively directing processed air from the flush flow structure to the first end of each one of the heat exchange chambers at different intervals of time;

(5) an outlet flow structure connected to the low pressure region of the exhaust fan means and having outlet valve means, including at least three separate, independently-operable outlet valves, for selectively directing contaminated air out of the second end of each one of the heat exchange chambers to the outlet flow structure at different intervals of time; and (6) a combustion chamber common to and in fluid communication with the second end of each heat exchange chamber;

an improved hydraulic control system for minimizing variations in the operation of the RTO due to variations produced by ambient temperature conditions to which the RTO apparatus may be subjected, comprising:

a hydraulic power supply unit with a hydraulic pump, a pump drive motor and a hydraulic fluid reservoir;

a plurality of hydraulically-powered valve operator units, each unit being for operating a different one of the inlet, outlet and flush valves;

supply and return lines for carrying hydraulic fluid under pressure between the hydraulic power supply unit and the valve operator units;

means for maintaining the overall temperature of the hydraulic fluid in the hydraulic control system at a substantially constant temperature; and means for regulating flow rates of hydraulic fluid selectively passing through each of several selected valve operator units at a rate that is substantially constant over time for each respective valve operator unit.

6. The hydraulic control system of claim 5, wherein the means for maintaining includes:

heating means for increasing the temperature of the hydraulic fluid in the reservoir when it is below a first predetermined level;

cooling means for decreasing the temperature of the hydraulic fluid in the reservoir when it is above a second predetermined level; and insulating means, substantially surrounding the supply and return lines, for minimizing heat transfer between the lines and the ambient environment on account of temperature differences therebetween.

7. The hydraulic control system of claim 5, wherein:

the means for regulating flow rates includes at least one flow control valve means connected in series to each selected valve operator unit, and the selected valve operator units include each of the inlet, outlet and flush valve operator units.

8. The hydraulic control system of claim 7, wherein the means for regulatory flow rates comprises a plurality of flow control valve means each including a flow control valve structure having an inlet port and a pressure compensation mechanism and a temperature compensation mechanism responsive to variations in temperature and pressure of the hydraulic fluid at the inlet port to help maintain a pre-set level of flow through the control valve structure.

9. The hydraulic control system of claim 5, wherein:

the means for maintaining includes heating means for increasing the temperature of the hydraulic fluid in the reservoir when it is below a first predetermined level, and cooling means for decreasing the temperature of the hydraulic fluid in the reservoir when it is above a second predetermined level, and insulating means, substantially surrounding the supply and return lines, for minimizing heat transfer between the lines and the ambient environment on account of temperature differences therebetween; and the means for regulating flow rates includes at least one pressure and temperature-compensated flow control valve means connected in series to each selected valve operator unit.

10. A method of continuously operating regenerative thermal oxidation ("RTO") equipment of the type including an exhaust fan with low and high pressure sides, at least first, second and third heat exchange chambers in fluid communication with an inlet flow structure, an outlet flow structure in fluid communication with the low pressure side of the exhaust fan, and a flush flow structure in fluid communication with the high pressure side of the exhaust fan, each heat exchange chamber containing heat exchange media through which contaminated air is passed, and a combustion chamber common to and in fluid communication with each of the heat exchange chambers, the method providing a substantially steady-state flow of contaminated air through the RTO equipment, comprising the steps of:

(a) during a first interval of time, (1) selectively directing contaminated air from the inlet flow structure through the first heat exchange chamber, then to the combustion chamber, then to the second heat exchange chamber, and then to the exhaust fan, and (2) selectively directing processed air from the flush flow structure through the third heat exchange chamber;

(b) during a second interval of time following the first interval of time, selectively directing contaminated air from the inlet flow structure through the first heat exchange chamber, then to the combustion chamber, then to the third heat exchange chamber, and then to the exhaust fan;

(c) during a third interval of time following the second interval of time, (1) selectively directing contaminated air from the inlet flow structure through the second heat exchange chamber, then to the combustion chamber, then to the third heat exchange chamber, and then to the exhaust fan, and (2) selectively directing processed air from the flush flow structure through the first heat exchange chamber;

(d) during a fourth interval of time following the third interval of time, selectively directing contaminated air from the inlet flow structure through the second heat exchange chamber, then to the combustion chamber, then to the first heat exchange chamber, and then to the exhaust fan;

(e) during a fifth interval of time following the fourth interval of time, (1) selectively directing contaminated air from the inlet flow structure through the third heat exchange chamber, then to the combustion chamber, then to the first heat exchange chamber, and then to the exhaust fan, and (2) selectively directing processed air from the flush flow structure through the second heat exchange chamber; and (f) during a sixth interval of time following the fifth interval of time, selectively directing contaminated air from the inlet flow structure through the third heat exchange chamber, then to the combustion chamber, then to the second heat exchange chamber, and then to the exhaust fan; and (g) successively repeating steps (a) through (f) in sequence to maintain a substantially steady-state flow of contaminated air through the RTO equipment.

11. The method of claim 10, in which the flow of contaminated air flow is further maintained at a constant rate, by the further step of:

selectively recirculating processed air from the high pressure side of the exhaust fan to the low pressure side of the exhaust fan.

12. The method of claim 10, wherein the step of selectively recirculating is performed during the second, fourth and sixth intervals of time, but not during the first, third and fifth intervals of time.

13. The method of claim 10, wherein during the second, fourth and sixth intervals of time associated with steps (b), (d) and (f), respectively, the heat exchange chamber which was connected to the outlet flow structure in the previous interval of time is an idle heat exchange chamber, such that substantially no contaminated air or processed air flows through such heat exchange chamber.

14. The method of claim 10, wherein:

the first, third and fifth intervals of time associated with steps (a), (c) and (e) respectively are each substantially equal to a first length of time, and the second, fourth and sixth intervals of time associated with steps (b), (d) and (f) are each substantially equal to a second length of time.

15. The method of claim 14, wherein first and second lengths of time are substantially equal.

16. The method of claim 15, wherein the first and second lengths of time are each about twenty seconds long.

17. A method of continuously operating regenerative thermal oxidizer ("RTO") equipment of the type including an exhaust fan with low and high pressure sides, at least first, second and third heat exchange chambers in fluid communication with an inlet line flow structure having at least first, second and third inlet valves each associated a respective one of the heat exchange chambers, an outlet flow structure in fluid communication with the low pressure side of the exhaust fan and having first, second and third outlet valves each associated with a respective one of the heat exchange chambers, each heat exchange chamber containing heat exchange media through which contaminated air is passed, and a combustion chamber common to and in fluid communication with each of the heat exchange chambers, the method providing a relatively constant flow of contaminated air through the RTO equipment, comprising the steps of:

(a) during a first interval of time, directing contaminated air from the inlet flow structure through the first heat exchange chamber, then to the combustion chamber, then to the second heat exchange chamber, and then to the exhaust fan;

(b) during a second interval of time following the first interval of time, (1) directing contaminated air from the inlet flow structure through the first heat exchange chamber, then to the combustion chamber, then to the third heat exchange chamber, and then to the exhaust fan, and (2) substantially stopping processed air from flowing through the second heat exchange chamber;

(c) during a third interval of time following the second interval of time, directing contaminated air from the inlet flow structure through the second heat exchange chamber, then to the combustion chamber, then to the third heat exchange chamber, and then to the exhaust fan;

(d) during a fourth interval of time following the third interval of time, directing contaminated air from the inlet flow structure through the second heat exchange chamber, then to the combustion chamber, then to the first heat exchange chamber, and then to the exhaust fan, and (2) substantially stopping processed air from flowing through the third heat exchange chamber;

(e) during a fifth interval of time following the fourth interval of time, (1) directing contaminated air from the inlet flow structure through the third heat exchange chamber, then to the combustion chamber, then to the first heat exchange chamber, and then to the exhaust fan; and (f) during a sixth interval of time following the third interval of time, directing contaminated air from the inlet flow structure through the third heat exchange chamber, then to the combustion chamber, then to the second heat exchange chamber, and then to the exhaust fan, and (2) substantially stopping processed air from flowing through the first heat exchange chamber; and (g) successively repeating steps (a) through (f) in sequence to maintain a relatively steady-state flow of contaminated air through the oxidizer equipment.

18. The method according to claim 17, wherein each of the intervals of time are substantially equal in length, and last about 20 seconds.

19. In a regenerative thermal oxidizer provided with a self-cleaning cycle for baking out contaminants deposited internally on portions of the oxidizer over time by a source of contaminated air, the oxidizer equipment being of the type including an exhaust fan with low pressure side and high pressure side, at least first, second and third heat exchange chambers in fluid communication with an inlet line flow structure, an outlet flow structure in fluid communication with the low pressure side of the exhaust fan, each heat exchange chamber containing heat exchange media through which contaminated air is passed, and a combustion chamber common to and in fluid communication with each of the heat exchange chambers, and a recirculation flow structure for returning processed air from the high pressure side of the exhaust fan to the inlet flow structure, an improved exhaust stack structure for boosting the efficiency of the self-cleaning cycle, comprising:

an elongated, vertically arranged exhaust stack connected to and in fluid communication the high pressure side of the exhaust fan; and damper valve means connected to the exhaust stack for automatically prohibiting entry of a stream of fresh air into the exhaust stack structure and for automatically allowing heated processed air to escape the exhaust stack.

20. The exhaust stack structure of claim 19, wherein:

the damper valve means includes a damper structure which is arranged to be closed by gravity, and opened by an upwardly-directed stream of heated processed air rising up the exhaust stack.

21. The exhaust stack structure of claim 20, wherein:

the exhaust stack is substantially cylindrical, and the damper structure is mounted within the exhaust stack, and includes pair of semi-circular plates, each plate being mounted for pivoting motion about an axis, with the axes of the pair of plates being substantially adjacent to one another.

* * * * *